United States Patent [19]

Stolcenberg et al.

[11] Patent Number: 4,651,873

[45] Date of Patent: Mar. 24, 1987

[54] CAN CADDY DEVICE, AND METHODS OF CONSTRUCTING AND UTILIZING SAME

[76] Inventors: Dennis A. Stolcenberg, 825 Floyd, SW., Wyoming, Mich. 49509; Raymond R. Ketelhut, 4887 Elmwood, Muskegon, Mich. 49441; Richard A. Forrest, 3104 Pontaluna Rd., Fruitport, Mich. 49415

[21] Appl. No.: 794,691

[22] Filed: Nov. 4, 1985

[51] Int. Cl.[4] ..... B65D 71/00

[52] U.S. Cl. ..... 206/142; 206/199; 206/486; 206/427; 206/806; 211/13; 211/73

[58] Field of Search ..... 206/142, 151, 139, 199, 206/203, 427, 486, 490, 806; 211/13, 60 A, 73

[56] References Cited

U.S. PATENT DOCUMENTS

| | | | |
|---|---|---|---|
| D. 191,647 | 4/1960 | Seeger | 211/13 |
| 3,868,140 | 2/1975 | Gordon | 206/139 |
| 3,919,379 | 11/1975 | Smarook | 206/203 |
| 4,232,807 | 11/1980 | Beier et al. | 206/151 |
| 4,236,638 | 12/1980 | Griffith | 206/427 |
| 4,487,312 | 12/1984 | Heider | 206/151 |
| 4,520,924 | 6/1985 | Edwards et al. | 206/150 |
| 4,542,827 | 9/1985 | Pilzer | 206/806 |
| 4,545,480 | 10/1985 | Klygis | 206/151 |

*Primary Examiner*—Stephen P. Garbe
*Assistant Examiner*—Brenda J. Ehrhardt
*Attorney, Agent, or Firm*—Irving M. Weiner; Joseph P. Carrier; Pamela S. Burt

[57] ABSTRACT

A beverage container holder having a unitary body, apertures therein adapted to receive said containers, and a handle for easy hand carrying.

11 Claims, 3 Drawing Figures

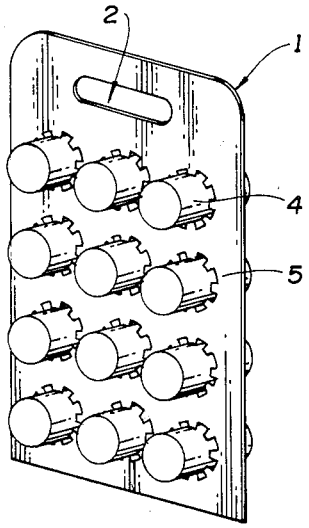
Fig. 1
Fig. 2
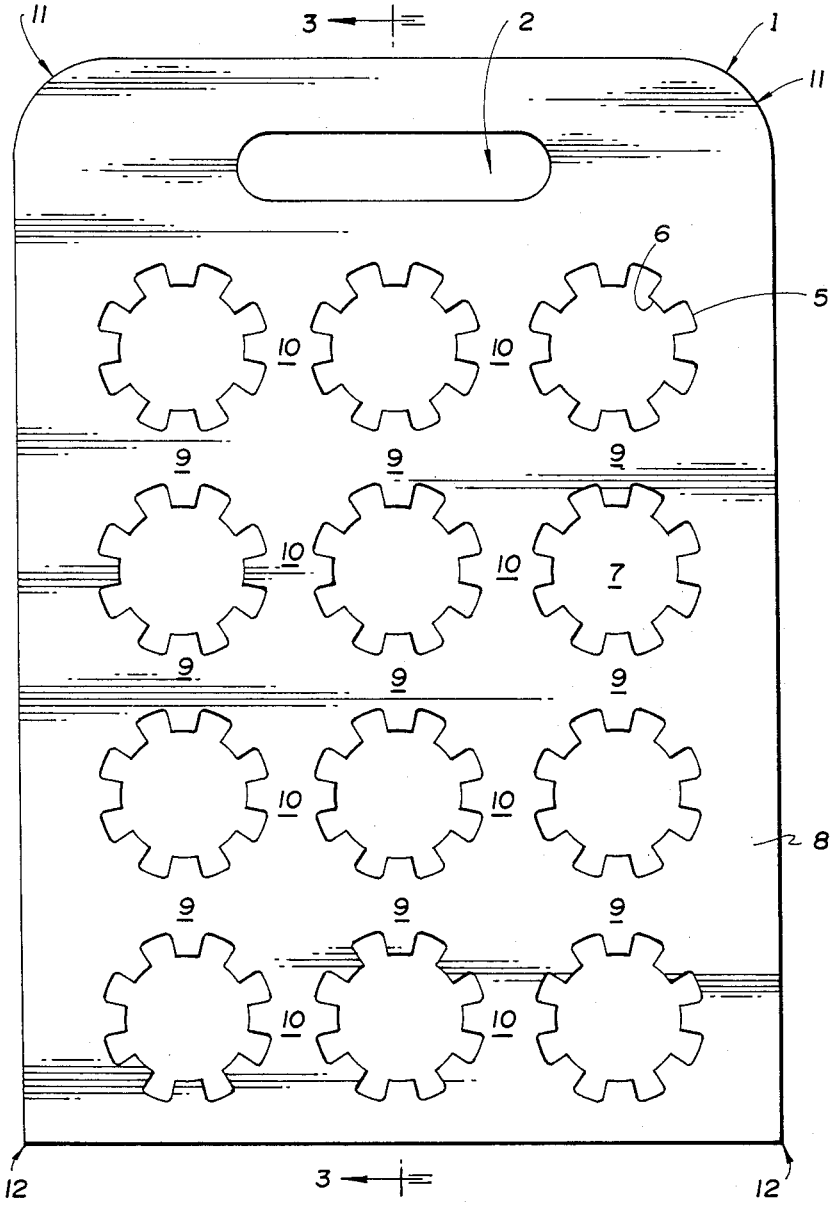
Fig. 3
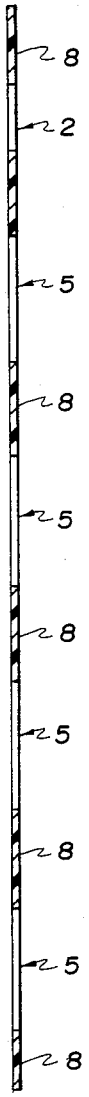

CAN CADDY DEVICE, AND METHODS OF CONSTRUCTING AND UTILIZING SAME

BACKGROUND OF THE INVENTION

1. Field of the Invention

The present invention relates broadly to container carrying means, and more particularly to a device for carrying beverage cans.

2. Description of the Relevant Art

In the past there has been a wide assortment of beverage can carriers. Most of these have amounted to mere packaging devices which had bowling grip carrier means for transporting the containers. An example of this kind of multipackaging device would be U.S. Pat. No. 4,121,712 which generally resembles the common plastic packaging of canned beverages found on many of today's supermarket shelves. The common disadvantage of this invention is that the containers once removed cannot easily be put back into the packaging. Thus, the consumer is limited to carrying one type of brand with this packaging.

There have been, of course, other structures which have had the general purpose of providing a way of carrying a package of beverage containers. These are best exemplified by U.S. Pat. No. 4,269,314 which depicts a strap that goes around a group of cans and has a handle on said strap, and U.S. Pat. No. 4,520,924 which allows two six packs to be carried by one strap which encircles both of them and has a handle. However, It should be noted that U.S. Pat. No. 4,520,924 and U.S. Pat. No. 4,269,314 have the inherent flaw that as cans are removed from them, they are less likely to be able to hold or grip the remaining cans.

The present carrier seeks to overcome the inferior means for holding onto the above described packaging devices, and the inherent problem of beverage carriers, i.e., that they loose their grip as beverage containers are removed from the carrier. The proposed solution to these problems is arrived at by noting that if each beverage can is gripped separately, it will not matter whether several have been removed because they are all gripped independently of each other. Additionally, containers once removed from the carrier may be returned to it with ease or others may be substituted. A handle may be provided which allows a person to use their whole hand to grip the carrier should they so desire.

SUMMARY OF THE INVENTION

The present carrier for holding and carrying containers comprises a single sheet of polyethylene into which predetermined shaped and dimensioned apertures have been formed, and said apertures receive and hold the containers. Specifically, the article of manufacture is formed from a thin single sheet of plastic, having rounded upper corners, an aperture formed near the top of the sheet to provide carrying means, and an array of container holding means devised out of the plastic sheet in the same plane. Notably, said container holder means have resiliently flexible tabs for gripping the containers.

It is an object of the present invention disclosure to provide an easily manufactured device for carrying beverage cans.

It is another object of the present invention to provide means for carrying containers formed out of a single sheet of plastic.

BRIEF DESCRIPTION OF THE DRAWINGS

FIG. 1 is a perspective view of the invention in use showing an array of apertures having a plurality of containers gripped therein.

FIG. 2 is a front elevational view of the invention not in use showing the array of apertures and the elliptical opening adapted to a person's hand.

FIG. 3 is a cross sectional view along line 3—3 indicating the thinness and simplicity of the invention.

DETAILED DESCRIPTION OF PREFERRED EMBODIMENT

As the preferred embodiment of carrier 1 is more easily understood from FIG. 2, that will be described first.

This front elevational view of the carrier 1 in FIG. 2 shows the carrier 1 in a nonoperational use. As depicted it consists of a polyethylene sheet 8 which is flat on both its front and back sides. Only its front side is shown in FIG. 2. It has rounded top corners 11 and square bottom corners 12. Formed in polyethylene sheet 8 is an array of container holding apertures 5 which are substantially circular. The substantially circular apertures 5 are spaced equally horizontally 10 and spaced equally vertically 9 from each other. Each substantially circular aperture 5 has associated with it tabs 6 which are resiliently flexible, thereby allowing the containers 4 in FIG. 1 to be pushed through the substantially circular apertures 5. It should be noted that the ends of tabs 6 generally define a circle 7 which is of a predetermined size and slightly smaller in diameter than containers 4.

Polyethylene sheet 8 is constructed of low density polyethylene and is made of a thickness that is determined by tabs 6 since they are formed out of the same sheet such that they will have the gripping strength to hold containers 4. Another parameter of the polyethylene sheet 8 is that it be of a thickness such that it will not tear or stretch.

As can be seen in FIG. 1 each container 4 is gripped individually. This allows the containers 4 to be removed without affecting the ability of the carrier 1 to retain the other containers 4. Additionally, it may be observed that the containers 4 once in place in no way restrict the insertion of a hand into the elliptical opening 2 which provides a desirable means of holding onto the carrier 1. As shown in FIGS. 1–3, the elliptical opening 2 is formed near the top of the carrier 1, such that when the carrier is being held it extends in a substantially vertical plane. As may also be noted, the containers 4 are inserted into apertures 5 such that a substantial portion protrudes from the carrier's 1 back side. While this is desirable it is not necessary so long as containers 4 are inserted into apertures 5 just enough so that tabs 6 may grip them.

The relative thinness of carrier 1 with respect to its width is shown in FIG. 3. As will be noted, apertures 5 and elliptical opening 2 are formed from polyethylene sheet 8 such that they do not distort its relatively planar surface.

Although there has been described what is considered to be the preferred embodiment of the carrier 1, it will be understood that the carrier 1 may be embodied in other specific forms without departing from the spirit or central characteristics thereof. The present embodiment is, therefore, to be considered in all respects as illustrative, and not restrictive.

What is claimed is:

1. A hand carried article of manufacture for holding containers, comprising:

a substantially planar resilient member having a top and bottom with substantially flat front and back sides;

said resilient member having an array of apertures therein;

said apertures each having a plurality of means for gripping the body of each container inserted perpendicularly to the front and back sides;

means for a hand to hold onto said resilient member;

said means for a hand to hold onto said resilient member includes a substantially elliptical opening in said resilient member, able to accommodate an average size adult human hand; and said opening being positioned near the top side of said resilient member such that when the member is being held it extends in a substantially vertical plane.

2. The article of manufacture of claim 1, wherein:

said resilient member is a sheet of polymeric material; and said sheet of polymeric material being sufficiently thick to prevent stretching or tearing.

3. The article of manufacture of claim 2, wherein:

said apertures are substantially circular in configuration; and said means for gripping containers is adapted to engage intermediate portions of said containers.

4. The article of manufacture of claim 1, wherein: said resilient member is substantially rectangular.

5. The article of manufacture of claim 1, wherein:

said resilient member has substantially square bottom corners.

6. The article of manufacture of claim 1, wherein:

said resilient member has substantially rounded top corners.

7. The article of manufacture of claim 1, wherein:

said means for gripping containers includes a plurality of teeth-like tabs on the inner periphery of said apertures.

8. The article of manufacture of claim 7 wherein:

said tabs generally point inward;

said tabs are resiliently flexible; and said tabs lay substantially in the same plane as said resilient member.

9. The article of manufacture of claim 7, wherein:

said tabs are substantially square;

said tabs are formed from said resilient member; and said adjacent tabs are separated by a predetermined distance.

10. The article of manufacture of claim 7, wherein:

said tabs are arranged generally to define a circle of predetermined diameter within the periphery of said apertures.

11. A hand carried article of manufacture for holding containers, comprising:

a substantial planar resilient member having top, bottom, front and back sides;

said resilient member is a sheet of polymeric material;

said resilient member is substantially rectangular;

said resilient member has substantially flat front and back sides;

said resilient member has substantially square bottom corners;

said resilient member has substantially rounded top corners;

said resilient member having an array of apertures therein;

said apertures are substantially circular in configuration;

said apertures each having a plurality of means for gripping containers;

said means for gripping containers includes a plurality of teeth-like tabs on the inner periphery of said apertures;

said tabs generally point inward;

said tabs are resiliently flexible;

said tabs lay substantially in the same plane as said resilient member;

said tabs are substantially square;

said tabs are formed from said resilient member;

said adjacent tabs are separated by a predetermined distance;

said tabs are arranged generally to define a circle of predetermined diameter to grip the body of a container inserted perpendicularly within the periphery of said apertures; and means for a hand to hold onto said resilient member;

said means for a hand to hold onto said resilient member includes a substantially elliptical opening in said resilient member, able to accommodate an average size hand; and said opening being positioned near the top side of said resilient member such that when the member is being held it extends in a substantially vertical plane.

* * * * *